United States Patent [19]

Klotz et al.

[11] Patent Number: 4,539,082

[45] Date of Patent: Sep. 3, 1985

[54] WOVEN DIAPHRAGM FOR AQUEOUS ELECTROLYTES

[75] Inventors: Helmut Klotz, Berg.-Gladbach; Klaus Bloch, St.Augustin-Niederpleis, both of Fed. Rep. of Germany

[73] Assignee: Bayer Aktiengesellschaft, Leverkusen, Fed. Rep. of Germany

[21] Appl. No.: 617,691

[22] Filed: Jun. 6, 1984

[30] Foreign Application Priority Data

Jun. 11, 1983 [DE] Fed. Rep. of Germany ..... 3321159

[51] Int. Cl.[3] ..... C25B 1/00

[52] U.S. Cl. ..... 204/93; 204/98; 204/128; 204/129; 204/295; 204/296

[58] Field of Search ..... 204/98, 295, 296, 128, 204/129, 93; 428/225, 258

[56] References Cited

U.S. PATENT DOCUMENTS 2,942,327 6/1960 Corry ..... 428/258

4,432,859 2/1984 Andreassen ..... 204/296

*Primary Examiner*—John F. Niebling

*Attorney, Agent, or Firm*—Connolly and Hutz

[57] ABSTRACT

A woven diaphragm for a diaphragm electrolysis cell for electrolysis of aqueous solutions containing ions such as alkali metal ions, chloride ions, and sulfate ions which diaphragm comprises warp threads and weft threads. Both warp threads and weft threads are of multifil filaments. Weft threads contain less than about 200 per meter and warp threads contain less than 400 per meter.

29 Claims, No Drawings

WOVEN DIAPHRAGM FOR AQUEOUS ELECTROLYTES

BACKGROUND OF THE INVENTION

1. Field of the Invention

This invention relates to a woven diaphragm for aqueous electrolytes, such as alkali metal chloride solutions, hydrochloric acid solutions, and sulfuric acid solutions and for the electrolysis of water to which acids and/or alkalis have been added.

2. Description of the Prior Art

The technique of electrolysis by the diaphragm process is described in the relevant literature, cf. the article by Hund and Minz in Winnacker-Küchler "Chemische Technologie", Vol. 2. "Anorganische Technologie I", page 379 (1982), more particularly page 392, pages 404 et seq and pages 442 et seq.

Hitherto, the diaphragms used for the electrolysis of alkali metal chlorides have been, in particular random-fiber mats of asbestos fibers. The need to replace asbestos as far as possible has produced proposals to use fluorocarbon polymers for diaphragms in the form of woven fabrics or films, optionally incorporating inorganic fibers.

Hitherto, woven PVC cloths in particular have been used in the diaphragm process for the electrolysis of hydrochloric acid.

Woven fabrics of polytetrafluoroethylene fibers which have been hydrophilized by treatment with an acid and/or by irradiation have been proposed for the electrolysis of water.

An ideal diaphragm has to satisfy a number of in some cases conflicting, requirements, such as resistance to the electrolytes and the reaction products, adequate porosity for passage of the electrolyte, a good separation effect for the reaction products and also a low ohmic resistance.

Now, the present invention provides diaphragms which are distinguished in particular by the weave thereof.

SUMMARY OF THE INVENTION

The woven diaphragm in accordance with the invention is comprised of warp threads and weft threads where said warp threads and said weft threads are made up of multifil filaments and where said weft threads contain less than about 200 turns per meter. Also, in accordance with the invention is a process for the electrolysis of aqueous solutions containing alkali metal ions, chloride ions, sulfate ions, or mixtures thereof in a diaphragm electrolysis cell by electrolysizing the ion containing solutions in a cell containing the woven diaphragm.

DETAILED DESCRIPTION OF THE PREFERRED EMBODIMENTS

It has been found that it is particularly twist-free or low-twist weft threads which impart to the diaphragm a capillarity which provides for sufficient porosity for diffusion of the electrolyte and, at the same time, for a good separation effect for the electrolysis product.

Chemical resistance to electrolytes and electrolysis products depends upon the choice of the filament material. It is preferred to use fluorocarbon polymers which have optionally been hydrophilized. Polyvinylidene fluoride (PVDF) has proved to be particularly suitable for the electrolysis of hydrochloric acid, particularly when organic impurities are present in the hydrochloric acid to be electrolyzed. There is no need for PVDF to be hydrophilized.

Polyphenylene sulphide ("PPS") of the type commercially available under the brand name "RYTON" (Registered Trade Mark, Philipps Petroleum) is also particularly suitable.

Other suitable fluorocarbon polymers include polyethylene tetrafluoroethylene, copolymers containing polyethylene tetrafluoride and polytetrafluoroethylene. Such polymers are particularly useful for the electrolysis of sodium chloride.

The twist-free weft threads are in particular, made up of endless filaments. In some embodiments where twisted threads are used for the warp threads, they are made up of staple fibers. In such embodiments weaving may be carried out using a cottonizing auxiliary and the auxiliary in question optionally dissolved out at a later stage. In embodiments where twist-free endless filaments are used for the warp threads, the multifil filaments must be treated with preparations or sizes before weaving. Twisting to a level of at least 100 turns per meter eliminates the need to use such aids and also the expense involved in the subsequent removal thereof.

Preferred diaphragms according to the present invention contain from 4 to 28 weft threads per cm. The denier preferably should amount to from 280 to 1100 dtex, single or double, more preferably from 300 to 600 dtex, double. Each individual thread is preferably made up of from 20 to 70 individual filaments, more preferably from 35 to 55 individual filaments.

The warp preferably consists of from 25 to 100 warp threads per cm, more preferably from 45 to 70 warp threads per cm. The denier again preferably amounts to from 280 to 1100 dtex, more preferably from 350 to 700 dtex. In addition, the warp thread may have a twist of from 0 to 400 turns per meter, preferably from 100 to 200 turns per meter.

Within the limits mentioned above, warp and weft are preferably selected such that the diaphragm has a density of from 200 to 600 g/m$^2$, more preferably from 300 to 500 g/m$^2$ and most preferably from 350 to 1150 g/m$^2$. The warp and weft threads are preferably woven in linen weave, more preferably in linen rib weave.

After weaving, the cloth may be compacted by calendering. Although this increases the voltage drop across the diaphragm during electrolysis, the gaseous electrolysis products are obtained in a purer quality.

The present invention is illustrated by the following Examples:

EXAMPLE 1

Production of the diaphragm according to the present invention

A multifilament of polyvinylidene fluoride consisting of 42 individual filaments and having a denier of 550 dtex is used, twist-free for the weft thread and twisted with 130 turns per meter for the warp thread.

The multifilament is woven in linen rib weave with 57 warp threads per cm and 11.5 weft threads, double, per cm.

Electrolysis of hydrochloric acid

The diaphragm is installed in an experimental electrolysis cell comprising graphite electrodes. The graphite electrodes are provided with vertical slots in known manner. The electrodes were 11 cm tall and 7.3 cm wide. The interval between the electrodes was 4 mm. The diaphragm was installed with rubber seals between the electrode frames. 23% hydrochloric acid is introduced into the electrode compartment separated by the diaphragm. The depleted hydrochloric acid (18%) flows out together with hydrogen on the cathode side and together with chlorine on the anode side. The temperature of the hydrochloric acid was 85° C. Electrolysis was carried out using a current density of 5 kA/m$^2$. A voltage drop of 2.32 volts was reasured between th electrodes. A chlorine content of 2.7% was measured in the hydrogen on the cathode side, the purity of the chlorine on the anode side amounted to 99.7%.

EXAMPLE 2

The diaphragm used in Example 1 was additionally calendered under heat and pressure. Electrolysis was carried out in the same way as in Example 1. A voltage drop of 2.43 volts was measured. The hydrogen formed on the cathode side contained 0.7% of chlorine, the purity of the chlorine formed on the anode side amounted to 99.5%.

EXAMPLE 3

The diaphragm used was the same as in Example 1 and electrolysis was carried out in the same way as in that Example. However, 1% of orthodichlorobenzene was added to the hydrochloric acid as an organic impurity. The voltage drop measured 2.36 volts, the chlorine was 99.8% pure and the hydrogen gas contained 1% of chlorine as impurity.

What is claimed is:

1. A woven diaphragm for an electrolytic cell comprising warp threads and weft threads, wherein said warp threads and said weft threads comprise multifil filaments and said weft threads contain less than about 200 turns per meter.

2. A diaphragm as claimed in claim 1, wherein said weft threads contain less than 50 turns per meter.

3. A diaphragm as claimed in claim 1, wherein said warp threads contain less than 400 turns per meter.

4. A diaphragm as claimed in claim 1, wherein said warp threads contain from 100 to 200 turns per meter.

5. A diaphragm as claimed in claim 1, wherein said weft threads comprise from 20 to 70 individual filaments.

6. A diaphragm as claimed in claim 1, wherein said weft threads are made up of from 35 to 55 individual filaments.

7. A diaphragm as claimed in claim 1, wherein said weft threads comprise from 20 to 70 double filaments.

8. A diaphragm as claimed in claim 1, wherein said weft threads comprise from 35 to 55 double filaments.

9. A diaphragm as claimed in claim 1, wherein said warp threads and said weft threads have a denier of from 280 to 1100 dtex.

10. A diaphragm as claimed in claim 1, wherein said diaphragm has a weight per unit area of from 200 to 600 g/m$^2$.

11. A diaphragm as claimed in claim 1, wherein said diaphragm has a weight per unit area of from 300 to 500 g/m$^2$.

12. A diaphragm as claimed in claim 1, wherein said diaphragm has a weight per unit area of from 350 to 400 g/m$^2$.

13. A diaphragm as claimed in claim 1, wherein said diaphragm has a linen rib weave with from 4 to 28 weft threads/cm and from 25 to 100 warp threads/cm.

14. A diaphragm, as claimed in claim 1, wherein said warp threads and said weft threads are fluorocarbon polymers.

15. A diaphragm as claimed in claim 1, wherein said warp threads and said weft threads are polyphenylene sulphide.

16. In a process for the electrolysis of water employing aqueous solutions containing alkali metal ions, chloride ions, sulphate ions or mixtures thereof in a diaphragm electrolysis cell, the improvement comprises electrolysizing said solution in said diaphragm electrolysis cell having a diaphragm as claimed in claim 1.

17. A diaphragm as claimed in claim 14, wherein said weft threads contain less than 50 turns per meter.

18. A diaphragm as claimed in claim 14, wherein said warp threads contain less than 400 turns per meter.

19. A diaphragm as claimed in claim 14, wherein said warp threads contain from 100 to 200 turns per meter.

20. A diaphragm as claimed in claim 14, wherein said weft threads comprise from 20 to 70 individual filaments.

21. A diaphragm as claimed in claim 14, wherein said weft threads are made up of 35 to 55 individual filaments.

22. A diaphragm as claimed in claim 14, wherein said weft threads comprise from 20 to 70 double filaments.

23. A diaphragm as claimed in claim 14, wherein said weft threads comprise from 35 to 55 double filaments.

24. A diaphragm as claimed in claim 14, wherein said warp threads and said weft threads have a denier of from 280 to 1100 dtex.

25. A diaphragm as claimed in claim 14, wherein said diaphragm has a weight per unit area of from 200 to 600 g/m$^2$.

26. A diaphragm as claimed in claim 14, wherein said diaphragm has a weight per unit area of from 300 to 500 g/m$^2$.

27. A diaphragm as claimed in claim 14, wherein said diaphragm has a weight per unit area of from 350 to 400 g/m$^2$.

28. A diaphragm as claimed in claim 14, wherein said diaphragm has a linen rib weave with from 4 to 28 weft threads/cm and from 25 to 100 warp threads/cm.

29. In a process for the electrolysis of water employing aqueous solutions containing alkali metal ions, chloride ions, sulphate ions or mixtures thereof in a diaphragm electrolysis cell, the improvement comprising electrolysizing said solution in said diaphragm electrolysis cell having a diaphragm as claimed in claim 14.

* * * * *